United States Patent [19]

Yamakawa et al.

[11] Patent Number: 4,863,296

[45] Date of Patent: Sep. 5, 1989

[54] INFORMATION PROCESSING APPARATUS

[75] Inventors: Kiyoshi Yamakawa, Gifu; Yoshio Sugiura; Satoru Tsuruki, both of Aichi, all of Japan

[73] Assignee: Brother Kogyo Kabushiki Kaisha, Aichi, Japan

[21] Appl. No.: 132,222

[22] Filed: Dec. 14, 1987

[30] Foreign Application Priority Data

Dec. 15, 1986 [JP] Japan ..... 61-298302

[51] Int. Cl.[4] ..... B41J 5/30; B41J 3/46

[52] U.S. Cl. ..... 400/63; 400/74; 400/83

[58] Field of Search ..... 400/63, 74, 83; 434/227

[56] References Cited

U.S. PATENT DOCUMENTS

| | | | |
|---|---|---|---|
| 4,270,865 | 6/1981 | Konishi | 400/63 |
| 4,348,189 | 9/1982 | Sapp | 434/227 |
| 4,373,192 | 2/1983 | Yanagiuchi et al. | 400/83 |
| 4,674,065 | 6/1987 | Lange et al. | 400/63 |
| 4,689,768 | 8/1987 | Heard et al. | 400/63 |

FOREIGN PATENT DOCUMENTS

| | | | |
|---|---|---|---|
| 123468 | 9/1980 | Japan | 400/63 |
| 134491 | 10/1980 | Japan | 400/63 |
| 11265 | 2/1981 | Japan | 400/63 |

OTHER PUBLICATIONS

Hackett, "Spelling-Checking Typewriter", IBM Technical Disclosure Bulletin, vol. 18, No. 2, pp. 530–531, 7/75.

Barker et al., "Method for Detecting . . . ", IBM Technical Disclosure Bulletin, vol. 25, No. 8, p. 4225, 1/83.

*Primary Examiner*—William Pieprz

*Attorney, Agent, or Firm*—Lowe, Price, LeBlanc, Becker & Shur

[57] ABSTRACT

An information processing apparatus includes input means for inputting data such as characters or symbols, a display device for displaying the input data successively, an information memory for storing information corresponding to the input data, retrieving means for retrieving information corresponding to the input data from the information memory, display means for displaying information which is retrieved by the retrieving means to a position corresponding to a position at which the input data is displayed in the display device, and instruction means for indicating the completion of input of at least one input data, instructing the retrieving means to conduct a processing for retrieving information concerning the input data, and instructing the display means to conduct a processing for displaying the information retrieved by the retrieving means.

14 Claims, 10 Drawing Sheets

INFORMATION PROCESSING APPARATUS

FIELD OF THE INVENTION

The present invention relates to an information processing apparatus and, more particularly, to apparatus capable of retrieving information such as a correct spelling, a synonym, a part of speech, a conjugation form as grammatical information or various items of information concerning a person's name, a firm name, and a place name, corresponding to input data such as a word, a person's name, a firm name, or a place name, from an information memory to display the same on a display.

BACKGROUND OF THE INVENTION

In a conventional data processing apparatus such as an electronic typewriter or a word processor, typically there is provided therewith a dictionary memory for storing a plurality of words, a spelling check is conducted for each input word, and when a misspelled word is detected a candidate word which is to be used for correcting the misspelled word is retrieved from the dictionary memory to be displayed, and the misspelled word is replaced by the correctly spelled word.

In such a conventional data processing apparatus, when a plurality of misspelled words are detected, it is not possible to display the candidate word corresponding to the misspelled word at each of a plurality of positions, and it is not possible to see a candidate word corresponding to the next misspelled word until an instruction is provided by the user indicating as to whether a particular misspelled word should be replaced by the correctly spelled word corresponding to that particular misspelled word.

Such apparatus, therefore, does not have the facility to select the most appropriate word from among a plurality of candidate words, i.e., potentially correctly spelled replacement words, through the comparison and examination of the relationships with misspelled words detected at a plurality of positions and the candidate words and this results in reduced precision and a low efficiency in the data input operation.

SUMMARY OF THE INVENTION

An object of the present invention is to provide an information processing apparatus that is capable of enhancing the performance of information processing work smoothly and rapidly, by retrieving information corresponding to input data, and displaying the information at a position corresponding to the input data, without obstructing the display of the input data itself.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there are provided input means for inputing data such as characters or symbols, display means for displaying the input data successively on a display, an information memory for storing information corresponding to the input data, retrieving and outputting means for retrieving information corresponding to the input data from the information memory, information display means for displaying the information output from the retrieving means at a position corresponding to the display position of the input data. Thus, the input data and the information retrieved on the basis of the input data can be easily compared and examined, the operability of the data input is enhanced, and the information processing work can be conducted smoothly and rapidly.

DETAILED DESCRIPTION OF THE PREFERRED EMBODIMENTS

A preferred embodiment of the present invention will now be described with reference to the drawings.

Figure 1:
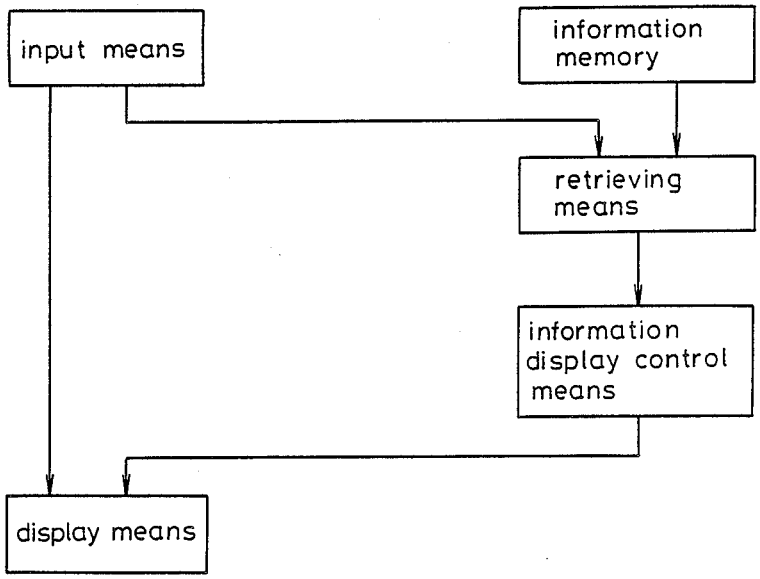
FIG. 1 is a block diagram showing an information processing apparatus of an embodiment of the present invention.
Figure 2:
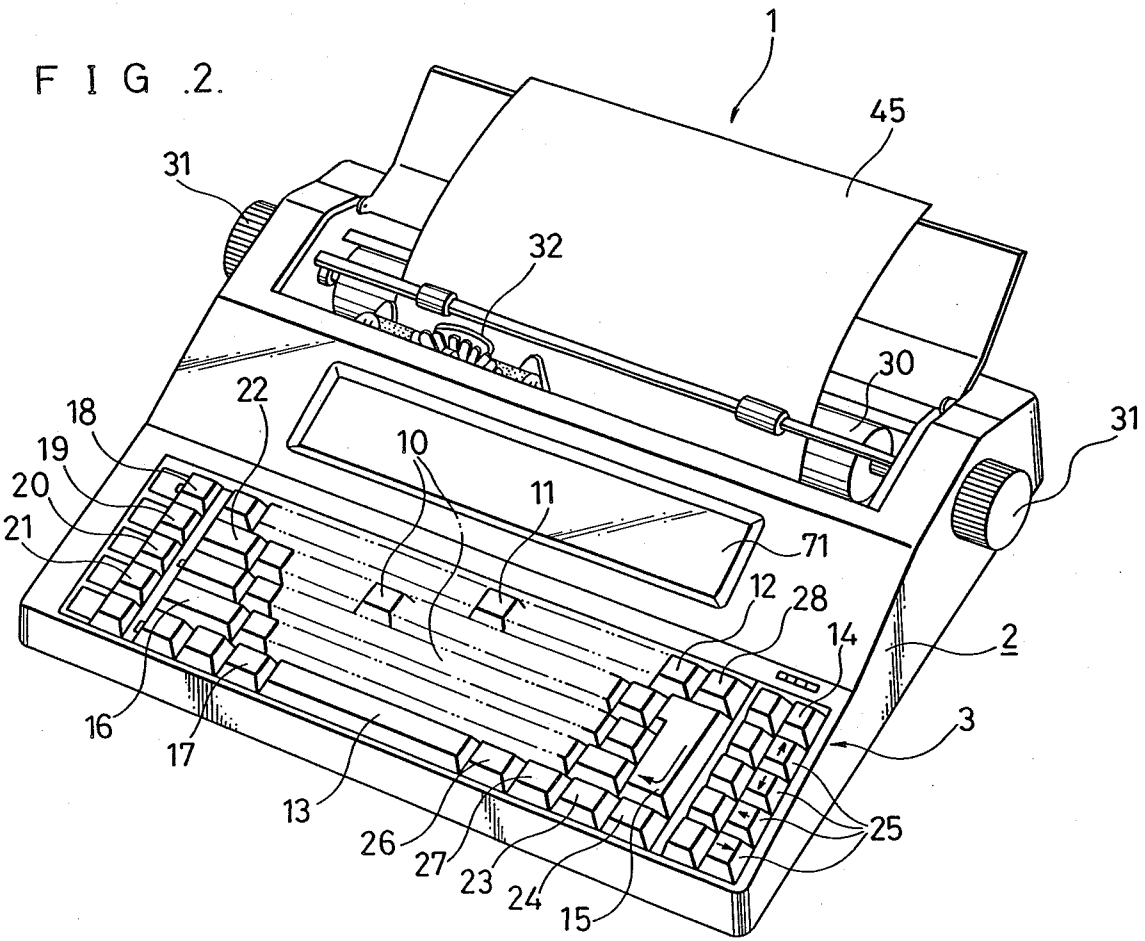
FIG. 2 is a perspective view showing an electronic typewriter as an embodiment of the present invention.

As best seen in FIG. 2, a keyboard 3 is arranged at the front portion of the body frame 2 of an electronic typewriter 1, and a printing machine PM is arranged at the rear of the keyboard 3 in the main body frame 2.

The keyboard 3 has a variety of keys such as the following: a character/symbol key including alphabetical key 15, numeral key 11, symbol key 12, a space key 13, a back space key 14, a return key 15, a shift key 16, a code key 17, a left margin set key 18, a right margin set key 19, a tab set key 20, a tab clear key 21, a tab key 22, a paper forward key 23, a paper return key 24, a cursor moving key 25, a word correction key 26, a line correction key 27, and a next candidate key 28. The word correction key 26 is the key for instructing performance of spell check work for each word, and the line correction key 27 is the key for instructing a quantity of bundled spell check work for a plurality of words which are successively input. The next candidate key 28 is a key for calling a next candidate, i.e., a correctly spelled word, at the spelling check. The other functions and operations obtained by operating the above described variety of keys are almost the same as those in a conventional typewriter.

There is provided an LCD display (liquid crystal display) 71 for displaying characters or symbols input by the operation of the character/symbol keys 10, 11, and 12 or a space key 13 at the rear portion of the keyboard 3.

Figure 3:
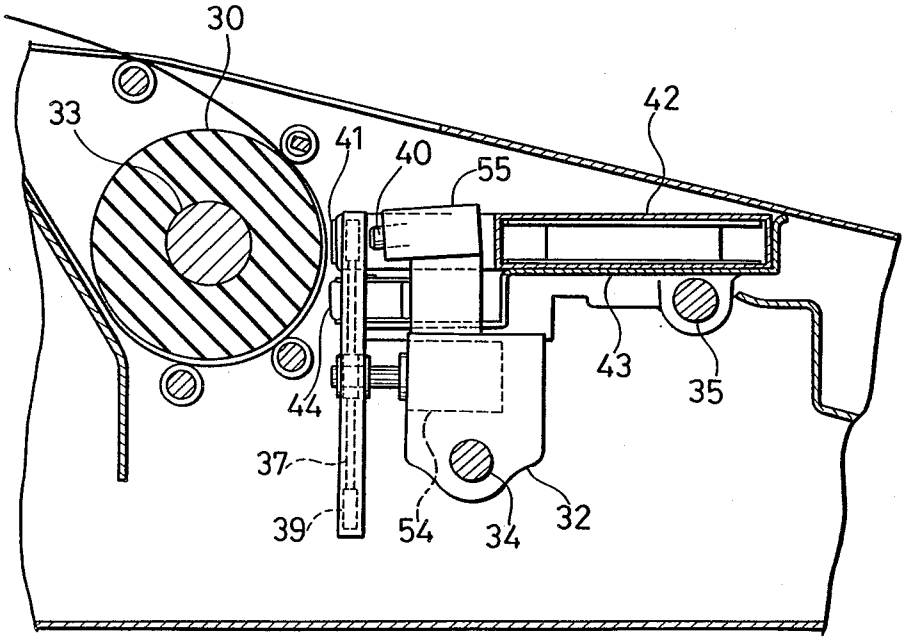
FIG. 3 is a cross-sectional side view of a main portion the electronic typewriter of FIG. 2.

In the printing machine PM, a platen 30 is arranged in the left-and-rightwards direction of the main body frame 2, and a printing paper 45 is designed to be set automatically or by manual by a platen driving motor (not shown in FIG. 2) or a platen knob 31. A carriage 32 is supported by a pair of guide axes 34 and 35 provided in parallel with the platen axis 33, as shown in FIG. 3. A daisy wheel driving motor 54 for driving a daisy wheel 37 is arranged at the carriage 32, and the daisy wheel 37 is attached to the motor shaft thereof. A printing hammer 40 for hitting one printing type of the daisy wheel 37 is attached to the top portion of the carriage 32, and it is driven by a printing hammer solenoid 55. A ribbon cassette 42 containing a printing ribbon 41 is installed on the holder 43. A correction ribbon 44 having a supply spool and a rewinding spool is arranged at a rear portion of the holder 43 (the left portion of FIG. 3), at a stage lower by one stage than the printing ribbon. A ribbon lift motor (not shown in FIG. 3) is provided so as to change the position of the holder 43 to a printing position in which the printing ribbon 41 is positioned at a printing position (refer to FIG. 3), a stop position in which the printing ribbon 41 is moved downwards to below the printing position (not shown), or a correction position in which the correction ribbon 44 is positioned at a printing position (not shown).

Figure 4:
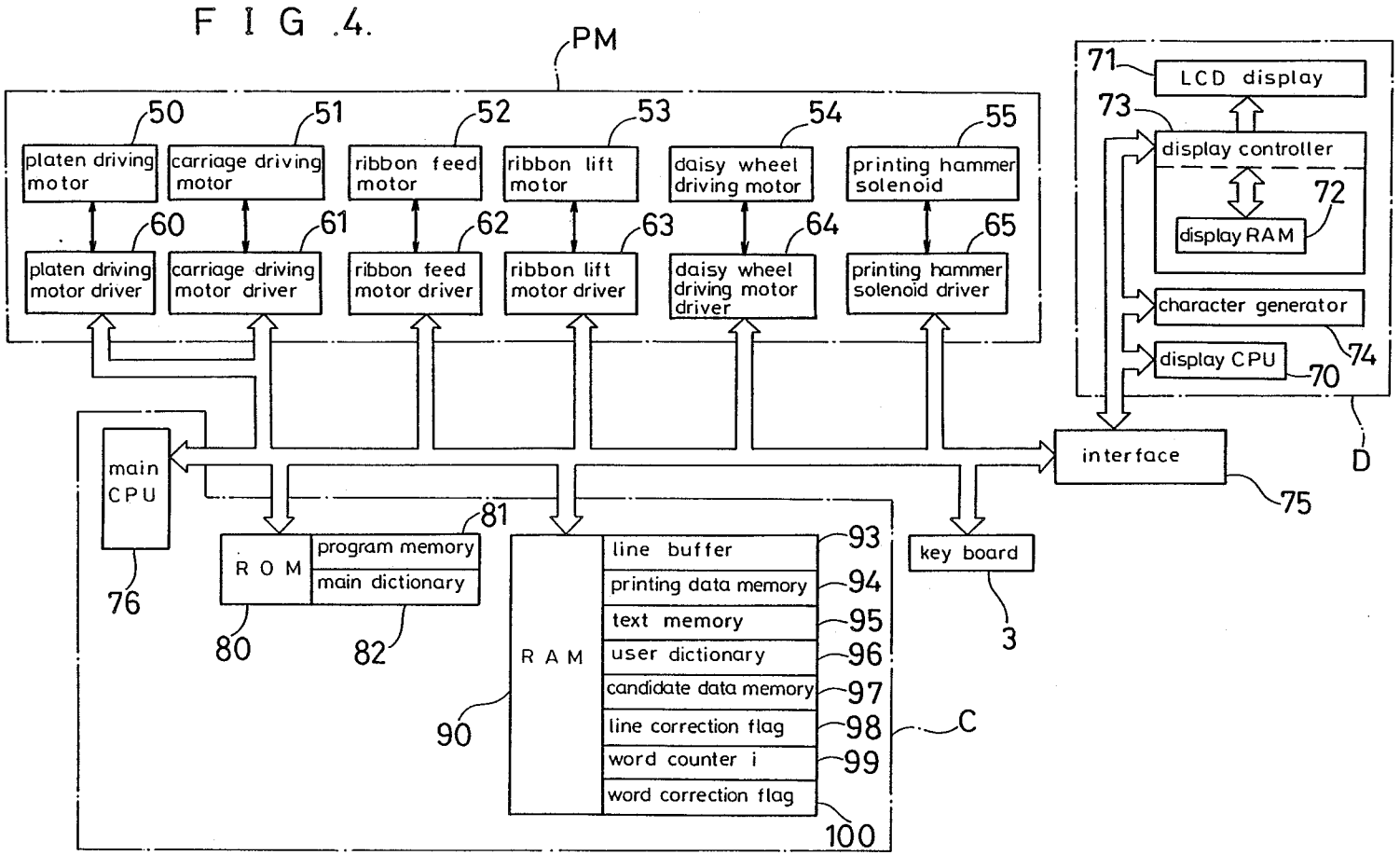
FIG. 4 is a block diagram showing a control system of the electronic typewriter of FIG. 2.
Figure 5A:
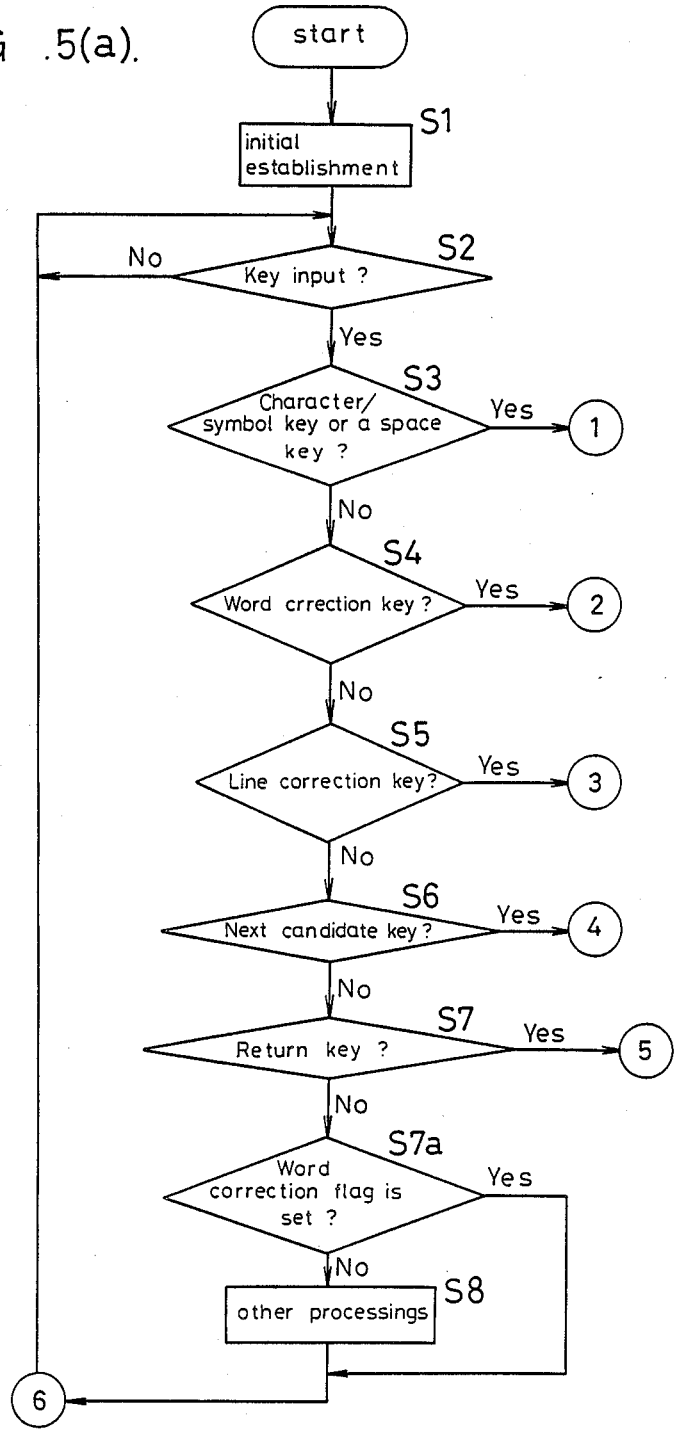
FIG. 5*a*–5*f* is a diagram showing a flow-chart of the control routine.
Figure 5B:
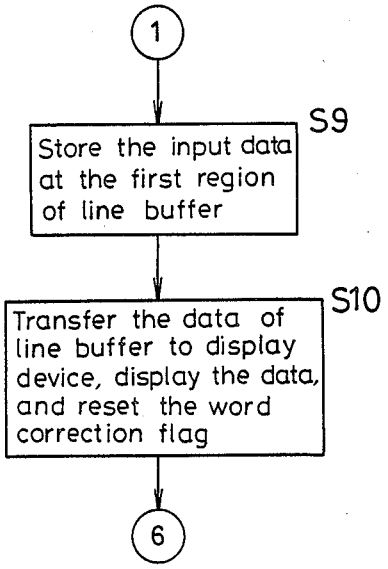
Figure 5C:
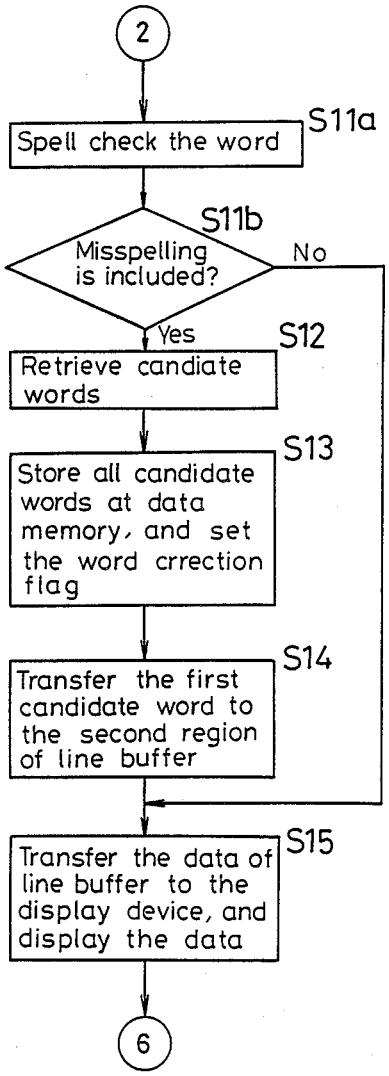
Figure 5D:
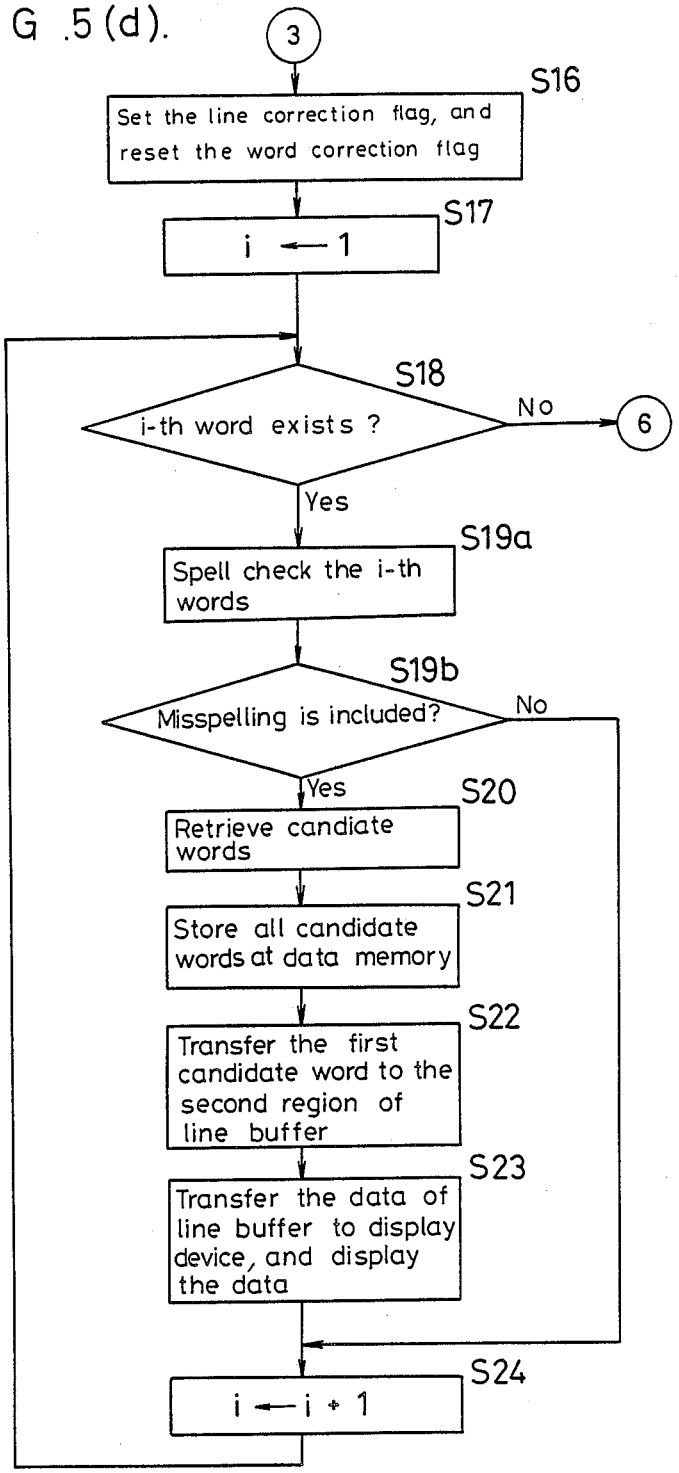
Figure 5E:
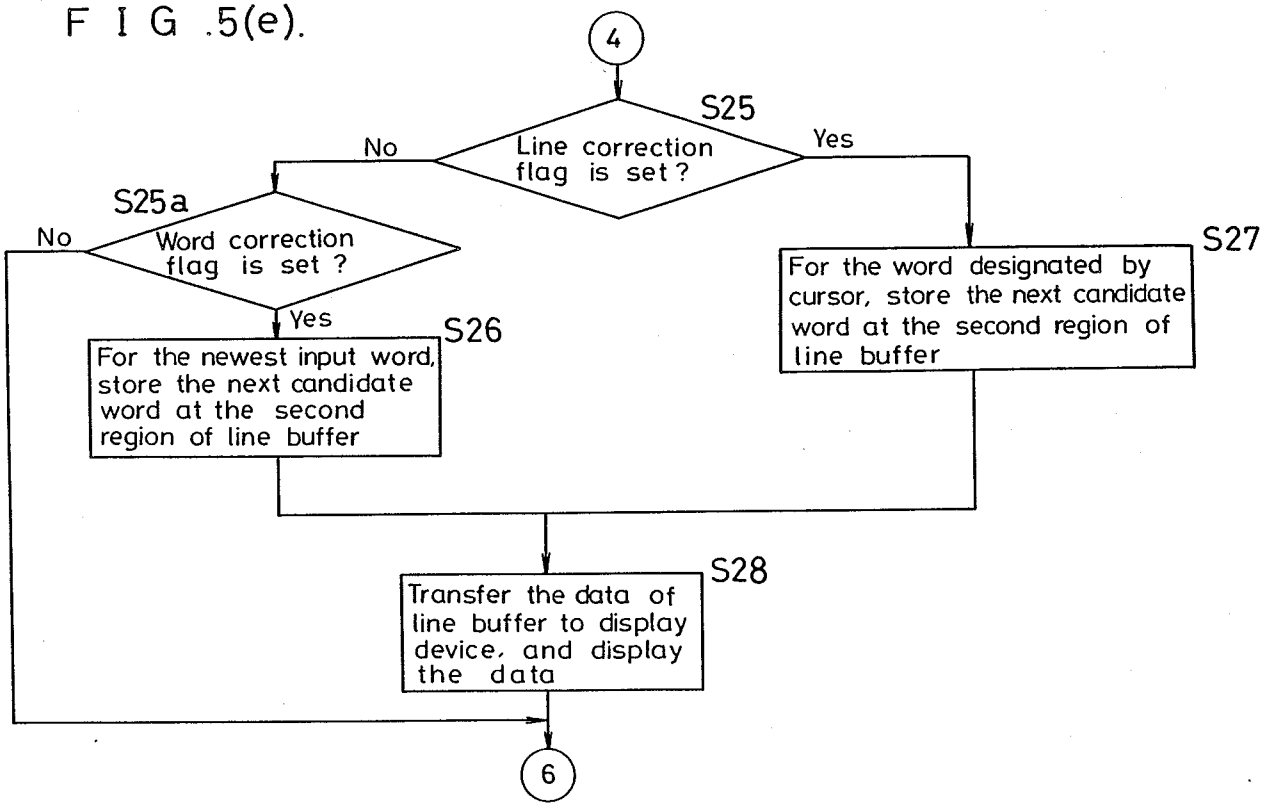
Figure 5F:
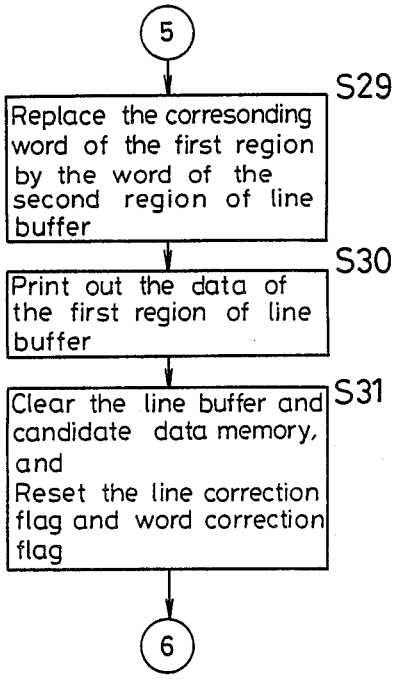

The construction of the control system of the typewriter 1 will now be described with reference to the block diagram of FIG. 4. The driving section of the printing machine PM comprises a platen driving motor 50 and its driver 60, a carriage driving motor 51 and its driver 61, a ribbon feed motor 52 and its driver 62, a ribbon lift motor 53 and its driver 63, a daisy wheel driving motor 54 and its driver 64, a printing hammer solenoid 55 and its driver 65. The drivers 60 to 65 of the printing machine PM are connected to the control apparatus C.

The display device D comprises a CPU for display control (central processing unit) 70, an LCD display for displaying characters or symbols of two lines 71, a display controller for storing the display data at a display RAM 72 corresponding to each display position of the LCD display 71, and a character generator 74 storing the display dot pattern for the LCD display 71 corresponding to code data elements such as characters or symbols. The display CPU 70 is designed to read out the corresponding display pattern from the character generator 74 on the basis of the command data and character code data output from the main CPU 76 through the interface 75 and outputs the same to the display controller 73. The display controller 73 outputs the display pattern data to the LCD display 71.

The control device C comprises a main CPU (central processing unit) 76, a ROM (read only memory) 80 and a RAM (random access memory) 90 connected to the main CPU 76. A keyboard 3 and each driver 60 to 65 of the printing machine PM and an interface 75 are connected to the main CPU 76 through a data bus.

At the program memory 88 of the RAM 80 there is a general control program such as a control program for controlling the respective motors 50 to 54, a printing hammer solenoid 55, and a display device D corresponding to the code data of respective characters input from the character/symbol keys 10, 11, 12 and a space key 13 of the keyboard 3, and a code data of respective functions input from a variety of kinds of function keys. Other than that, a control program for conducting a control particular to the present invention described later is stored at the program memory 81. Data relating to about seventy thousand words, including spellings, phrases, meanings, conjugation form variations, and synonyms are stored, classified in an alphabetical order as in a conventional dictionary, are stored at the main dictionary 82 of the ROM 80.

In the RAM 90, there are provided the following memories other than the general memories: various kinds of memories for storing temporarily the results obtained by the operation in the main CPU 76, e.g., a line buffer 93 for storing data of an input word of the newest line; a printing data memory 94 for storing the printed data in the order, corresponding to the printing positions at the typewriter mode in which data is printed for each key input or at the line-by-line mode in which one line of input data is printed accompanied with the carriage return operations; a text memory 95 for storing input data as a file data at the memory mode in which the input data is stored at a text memory; a user dictionary 96, for the user to store a word which is to be repeatedly read out and used, a candidate data memory 97, for storing all the correctly spelled candidate words obtained by retrieval from the dictionary 82, 96; a line correction flag 98, for judging whether the system is in the word correction mode or in the line correction mode; a word counter (i)99, for determining which word is to be processed; and a word correction flag 100.

The line buffer 93 has a first region for storing data relating to an input word of the newest one line, and a second region for storing data of a candidate word corresponding thereto.

The word correction mode which is judged by the line correction flag 98 is a mode for conducting a spelling check for each word each time that a word is input, and the line correction mode is a mode for conducting a spelling check for a plurality of words (for example, the words of an entire line).

The main CPU 76 makes the printing machine PM conduct printing of the data corresponding to the characters or symbols which are input from the character/symbol key 10, 11, 12 of the keyboard 3 to the printing paper 45 on the basis of a control program at the typewriter mode, and makes a printing data memory 94 of the RAM 90 store the printed data in the order corresponding to the printing position. In the memory mode, the main CPU 76 writes in the data corresponding to the input characters or symbols to the text memory 95 through the line buffer 93 of the RAM 90 on the basis of the control program. It also outputs the data of line buffer 93 to the display CPU 70 of the display device D and, at the same time, controls the cursor display position.

When the input data is a command data from a variety of function keys for operating the respective motors of the printing machine PM, the main CPU 76 outputs the control data corresponding to the input data to the drivers 60 to 65 by processing the data by a control program. Furthermore, in order to conduct a spelling check of the input word and the correction of the misspelling, the main CPU conducts a spelling check and retrieval of the candidate word, and also the display control of the input word and candidate word.

The control procedure of the word processing apparatus of the present invention will now be described with reference to FIGS. 5(*a*) to (*f*). In this embodiment, processing in the line-by-line mode will be described.

In FIG. 5(*a*), when a power is supplied to the typewriter the control will start. At first, at step S1, the control program stored at the program memory 81 of the ROM 80 will be read out to the main CPU 76, and after the initial activity such as resetting of the line correction flag 98 and the word correction flag 100 is conducted, it transits to step S2. At step S2, a key input is waited, and when there is a key input, it transits to step S3. At step S3, it is judged whether the input key is the character/symbol key 10, 11, 12 or a space key 13 or not. If it is not a character/symbol key 10, 11, 12 or a space key 13, it transits to step S4. At step S4, it is judged whether the input key is a word correction key 26 or not. If it is not a word correction key 26, it transits to step S5. At step S5, it is judged whether the input key is a line correction key 27 or not. If it is not a line correction key 27, it transits to step S6. At step S6, it is judged whether the input key is a next candidate key 28 or not. If it is not a next candidate key 28, it transits to step S7. At step S7, it is judged whether the input key is a return key 15 or not. If it is not a return key 15, it transits to step S7*a*. At step S7*a*, it is judged whether the word correction flag 100 is set or not. If the word correction flag 100 is set, it returns to step S2 but, at the initial state, the word correction flag 100 is not set and it transits to step S8.

At step S8, the apparatus is managed to conduct an operation like that on a conventional typewriter, on the basis of an instruction from the input key such as a cursor moving operation on the LCD display 71 by the cursor movement key 25. Thus, process of writing a special word, (such as a proper noun which the user especially uses) into the user dictionary 96, may be conducted as desired by the user. When the processing at step S8 is concluded, it returns to step S2. When the input key is a character/symbol key 10, 11, or 12 or a space key 13 at step S3, it transits to step S9 of FIG. 5(*b*). At step S9, the input data of the characters or symbols corresponding to the character/symbol key 10, 11, 12 or a space key 13 are stored at the first region of the line buffer 93. Next, it transits to step S10, and the data line of the buffer 93 is transferred to the display device D, and it is displayed on the LCD display 71. Furthermore, at step S10, a word correction flag 100 is reset. When the processing at step S10 is concluded, it returns to step S2. Then the character/symbols key 10, 11, and 12 or a space key 13 are touched successively in order to input a sentence, the above described process is repeated, the data of the characters or symbols corresponding to the input key or the data of the space are stored into the first region of the line buffer 93, and the characters or symbols sequence corresponding to the input data are displayed on the LCD display 71.

Figure 6A:
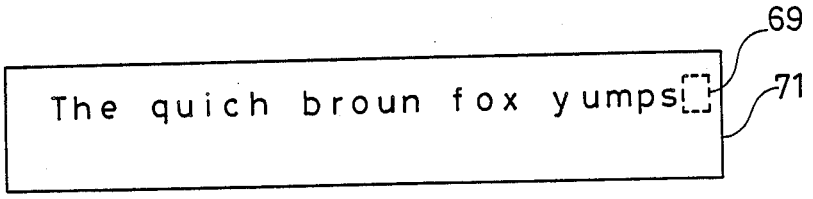
FIG. 6A, B and C are plan views illustrating sample displays on an LCD display.
Figure 6B:
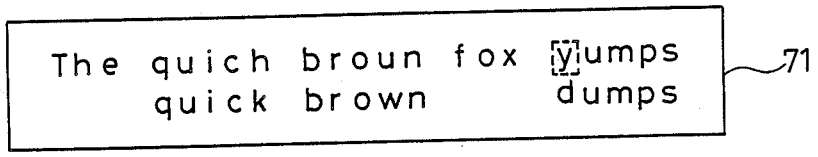
Figure 6C:
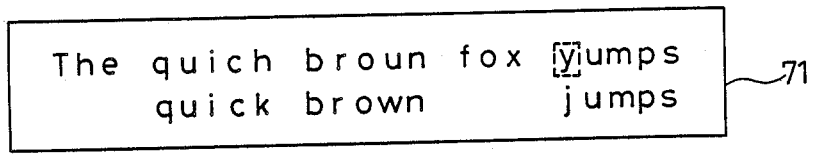

Herein, suppose that the input is conducted as shown in FIG. 6(*a*) and is displayed on the LCD display 71. In FIG. 6, among the two lines of the LCD display 71, the upper line corresponds to the first region of the line buffer 93 and the lower line corresponds to the second region of the line buffer 93. The reference numeral 69 designates a cursor.

When the word correction key 26 is touched after the input is conducted as shown in FIG. 6(*a*), it transits from step S4 of FIG. 5(*a*) to step S11 of FIG. 5(*c*). Herein, the touch of the word correction key 26 means the start of the processing of conducting spell check only for the input word (the newest word) and retrieval of the candidate words of correct spelling against the misspelled word. At step S11*a*, spelling check is conducted by retrieving the word of the same spelling in the dictionary 82 and 96 for the newest input word stored at the line buffer 93, and when it is judged there is a misspelling at step 11*b*, a word having only one character difference is retrieved thereby to execute retrieval of candidate words at step 12.

In the example of FIG. 6(*a*), spelling check and retrieval of candidate words are executed for the "yumps". When the misspelling does not exist, it transits to step S15, but when there is a misspelling, it transits to step S13. At step S13, all the candidate words detected from the dictionaries 82 and 96 are stored at the candidate data memory 97 as candidates of correct spelling. At step S13, a word correction flag 100 is set. Next, at step S14, a candidate word which is detected at first is transferred to a position corresponding to the misspelled word in the second region of the line buffer 93 ("yumps" in the example of FIG. 6(*a*)). Furthermore, at step S15, the data of the line buffer 93 is transferred to the display device D, and it is displayed at the lower line of the LCD display 71. When these processings are concluded, it returns to step S2 of FIG. 5(*a*).

When the next candidate word is desired to be displayed instead of the candidate word displayed at present, the next candidate key 28 is touched. The operation in this case will be described after the description of the line correction processing.

When the input key is a line correction key 27, it transits to step S16 of FIG. 5(*d*) from step S5. Herein, the touch of the line correction key 27 means the start of processing of a spelling check and retrieval of the candidate words for the misspelled words over all the words stored in the first memory of the line buffer 93. At step S16, the mode transits to the line correction mode by setting the line correction flag 98. At step S16, the word correction flag 100 is reset. At step S17, the word counter (i)99 is set to 1.

Next, at step S18, it is judged whether the i-th word exists or not at the first region of the line buffer 93. When the i-th word does not exist, it returns to step S2 of FIG. 5(*a*), and when the i-th word exists, it transits to step S19. At step S19*a*, for the i-th word spell check is conducted. When it is judged there is a misspelling in the i-th word at step 19*b*, retrieval of the candidate words is conducted by retrieving the dictionaries 82 and 96 at step 20. When a misspelling does not exist it transits to step S24, and after 1 is added to the word counter (i)99 it returns to step S18. When it is judged there exists a misspelling in the i-th word at step S19*b*, it returns to step S21. At step S21, all the candidate words detected from the dictionaries 82 and 96 are stored at the candidate data memory 97 as correctly spelled candidates. Next, at step S22, a candidate word which is detected at first among the candidate words is transferred to a position corresponding to the i-th word in the second region of the line buffer 93. Furthermore, at step S23, the data of the line buffer 93 is transferred to the display device D, and it is displayed at the lower line of the LCD display 71. When these processings are concluded, it transits to step S24, and after the word counter i is counted up, it returns to step S18. Thereafter, so long as the i-th word exists at the first region of the line buffer 93, the processings of steps S19 to S24 are repeated.

The processings at steps S18 to S24 will now be explained concretely with specific reference to FIGS. 6(*a*) through 6(*c*).

At first, the processing of step S19 is executed to the first word "The", and it is judged "No" at the step S20 because there is no misspelling in the word "The", and it transits to step S24. At step S24, 1 is added to the word counter (i)99 to set i to 2. Next, the processing at step S19 is conducted to the second word "quich", and at step S20 it is judged whether there exists a misspelling in this word, and it transits to step S24 through the processings of steps S21 to S23. At step S24, 1 is added to the word counter (i)99 thereby to set i to 3. Similarly as above, the words "broun" and "yumps" are subjected to the same processing as that in a case where it is judged that there exists a misspelling, and the word "fox" is subjected to the same processing as that in a case where it is judged that there exists no misspelling. As a result, the candidate words "quick", "brown", and "dumps" are transferred to the position in the second region of the line buffer 93 corresponding to the words "quich", "broun", and "yumps". By transferring the data of the line buffer 93 to a display device D, a display is conducted on the LCD display 71 as shown in FIG. 6(*b*). Finally, when the word counter (i)99 is set to 6 at step S24, it is judged "No" at step S18 because there exists no sixth word in the line buffer 93, and it returns to step S2 of FIG. 5(*a*).

At this stage the user notices the candidate words displayed on the LCD display 71, and judges as to whether the respective misspelled words are to be replaced by the candidate words displayed therefor. Now the user judges whether the displayed candidate word is to be changed and whether another candidate word is to be adopted, and when it is in a word correction mode the next candidate key 28 is simply touched. When it is in a line correction mode, the next candidate key 28 is touched after the cursor 69 is moved to designate the input word for which the next candidate word is to be obtained. For example, in the state of FIG. 6(*b*), when the next candidate word is to be obtained as a candidate word of "yumps", the cursor 69 is moved to designate "yumps" as shown in the drawing, and the next candidate key 28 is touched. When the next candidate key 28 is touched, it transits to the step S25 of FIG. 5(*e*).

At step S25, it is judged as to whether the line correction flag 98 is set or not. When the line correction flag 98 is set, it transits to the step S25*a* by judging that it is the next candidate processing at the word correction mode. At step S25*a*, it is judged whether the word correction flag 100 is set or not. When the flag 100 is not set, it returns to step S2 (FIG. 5(*a*)). When the flag 100 is set, it transits to step S26. At step S26, the next candidate word is read out from the candidate data memory 97 for the newest input word, and it is stored at the position of the second region of the line buffer 93 corresponding thereto. On the other hand, when the line correction flag 98 is set at step S25, it is judged that it is a next candidate processing at the line correction mode, and it transits to step S27. At step S27, the next candidate word is read out from the candidate word data memory 97 for the word designated by the cursor 69, and it is stored at the position of the second region of the line buffer 93 corresponding thereto. Thus, for example, as shown in FIG. 6(*b*), when the cursor 69 is moved to designate the "yumps", the "jumps" as next candidate word is read out from the candidate data memory 97 for the "yumps", and it is stored at the position of the second region of the line buffer 93 corresponding thereto. When the processings of steps S26 and S27 are concluded, it transits to step S28. At step S28, the data of the line buffer 93 is transferred to the display device D, and it is displayed on the LCD display 71. In a case of figure 6(*b*), "jumps" is displayed instead of "dumps" as shown in FIG. 6(*c*). When the processing at step S28 is concluded, it returns to step S2 of FIG. 5(*a*).

When watching the displayed candidate word, if the user judges that the misspelled word is to be replaced by the displayed candidate word, he or she touches the return key 15. When the return key 15 is touched, it transits to step S29 of FIG. 5(*f*) from step S7. At step S29, the corresponding word of the first region is replaced by the candidate word of the second region of the line buffer 93. In the example of FIG. 6(*c*), the sentence "The quich broun fox yumps" is replaced by "The quick brown fox jumps". Next, it transits to step S30, and the data of the first region of the line buffer 93 are printed on the printing paper 45 by the printing machine PM, and at the same time they are stored at the printing data memory 94. When the printing is concluded, it transits to step S31, and the line buffer 93 and the candidate data memory 97 are cleared, and after the line correction flag 98 and the word correction flag 100 are reset, it returns to step S2.

As described above, in the present embodiment, spelling check and retrieval of candidate words for a plurality of words can be conducted at one time, and the spelling check work can be conducted smoothly and rapidly, thereby enhancing the overall operation.

In the above-illustrated embodiment, the spelling check, the retrieval and display of the candidate word are conducted by touch of the line correction key 27. However, if a spelling check mode is provided the spelling check, the retrieval and display of the candidate word can be conducted by a first touch of the return key, and the printing of the data of the line buffer 93 can be conducted by a second touch of the return key after the next candidate or the like is confirmed.

In the above-described embodiment, an electronic typewriter having a two-line display device is described, but in an electronic typewriter having a one-line display device, the candidate word may be displayed by a technique such as a flashing at the side of the misspelled word.

In the above-described preferred embodiment, the input word is spelling checked, a candidate word for correcting the misspelled word is retrieved, and the misspelled word is replaced by the candidate word, but similarly stored synonyms or homophones of the input word may also be retrieved on the basis of an instruction from a synonym or homophone key to display the same. The input word may then be replaced by a synonym or a homophone.

In the alternative, conjugations (past, past participle, comparative degree, superlative degree, etc.) of the input word may be retrieved on the basis of an instruction from a conjugation retrieving key to display the same. Furthermore, the input word may itself be replaced by the conjugation. Also, the meaning of the input word (for example, a translation from English to Japanese, or from English to French) may be retrieved on the basis of an instruction from a meaning retrieving key and displayed on a display device.

The above-described operation is that in the line-by-line mode, but it can also be executed similarly in the typewriter mode in which the printing is successively conducted for each key input or, alternatively, in a memory mode in which the printing is conducted after storing a desired quantity of data. In the typewriter mode, however, the replacement into the candidate word is conducted by printing the candidate word and by erasing the word which is already printed by a correction ribbon. The control in the memory mode, i.e., the processing at the step S30, is made by writing-in processing into the text memory.

The information processing apparatus of the present invention can also be applied to applications other than those which retrieve dictionary information for the input word. For example, it is possible to conduct a general information processing by providing an information memory which stores data such as a person's name and firm name, and the data of the address corresponding thereto instead of a user dictionary, and retrieving the addresses corresponding to the input person's name or firm name to display the same.

In the above-described embodiment, the present invention is applied to an electronic typewriter provided with a daisy wheel, but the invention may also be applied to an electronic typewriter provided with a printing-ball type of printer, a thermal printer, a dot printer, a laser printer, or various kinds of word processors.

As is evident from the foregoing description, according to the present invention, there is provided retrieving means for retrieving information corresponding to input data from an information memory, and information display control means for displaying the information output from the retrieving means at a position corresponding to the display position of the input data. Therefore, the input data and the information retrieved on the basis of the input data can be easily compared and examined, and the operability of the data input activity is enhanced and the information processing work can be conducted smoothly and rapidly.

What is claimed is:

1. An information processing apparatus, which comprises:

input means for inputting word data;

first memory means for storing said input word data;

a display device for displaying said input word data successively;

second memory means for storing a plurality of candidate word data;

spelling check means for judging whether there exists a misspelling in each input word data stored in said first memory means on the basis of comparison with corresponding candidate word data of said second memory means;

retrieving means for retrieving from said second memory means a candidate word data corresponding to each of the misspelled input word data;

display means for simultaneously displaying, in a predetermined region of a display, each of said input word data having misspelling and said corresponding retrieved candidate word data at positions respectively adjacent thereto;

replacement means for replacing said misspelled input word data by said corresponding retrieved candidate word data; and instruction means for indicating the completion of input of at least one input word data, instructing said spelling check means to conduct a processing of said judgment, instructing said retrieving means to conduct a processing of said retrieval, instructing said replacement means to conduct a processing of said replacement, and instructing said display means to conduct a processing of said displaying.

2. An information processing apparatus as defined in claim 1, further comprising:

change means for changing the candidate word data by another candidate word data corresponding to each of said misspelled word data.

3. An information processing apparatus as defined in claim 1, wherein:

said instruction means instructs said retrieving means to conduct a processing for retrieving said candidate word data concerning only a word which is input just before.

4. An information processing apparatus as defined in claim 1, wherein:

said display device has a first region at which said input data are successively displayed, and a second region at which said candidate word data retrieved for said misspelled data are displayed.

5. An information processing apparatus as defined in claim 4, wherein:

said display device is a two-line display device, and said first region is one line of the two displayed lines and said second region is the remaining line.

6. An information processing apparatus as defined in claim 5, wherein:

said information memory comprises a dictionary memory, and said retrieving means, said spelling check means, said replacement means and said display means coact to comprise a program memory.

7. An information processing apparatus as defined in claim 6, wherein:

the apparatus is selected to be one of a word processor and a typewriter, and wherein said input means comprises a keyboard, said retrieving means retrieves a candidate word selected from correct words in said dictionary memory, which candidate word is to be used for the replacement of an input word consisting of the characters or symbols input from said keyboard, and said display means displays said candidate word retrieved by said retrieving means adjacently to said input word by executing instructions of said program memory.

8. An information processing apparatus as defined in claim 7, wherein:

said retrieving means further searches said input word from among said correct words in said dictionary memory and when no word coinciding with said input word is found, said retrieving means retrieves a candidate correct word.

9. An information processing apparatus as defined in claim 7, wherein:

said retrieving means comprises a counter for memorizing an order of an input word for which said retrieving means retrieves a candidate correct word, in said first region of said display device.

10. An information processing apparatus as defined in claim 1, further comprising:

designation means for designating one of all said retrieved candidate word data being displayed to a position adjacent to the display position of said each input word data having misspelling; and change means for changing the designated candidate word data for another candidate word data.

11. An information processing apparatus as defined in claim 10, wherein:

said replacements of said retrieved candidate word data are conducted concurrently for a plurality of said misspelled input word data.

12. An information processing apparatus, which comprises:

first memory means for storing said input word data;

a display device for displaying said input word data successively;

second memory means for storing a plurality of word data;

spelling check means for judging whether there exists a misspelling in each input word data stored in said first memory means on the basis of comparison with corresponding candidate word data of said second memory means;

retrieving means for retrieving from said second memory means a candidate word data corresponding to each of the misspelled input word data;

display means for simultaneously displaying in a predetermined region of a display, each of said input word data having misspellings and said corresponding retrieved candidate word data at positions respectively adjacent thereto;

replacement means for replacing said misspelled input word data by said corresponding retrieved candidate word data;

instruction means for indicating the completion of input of at least one input word data, instructing said spelling check means to conduct a processing of said judgment, instructing said retrieving means to conduct a processing of said retrieval, instructing said replacement means to conduct a processing of said replacement, and instructing said display means to conduct a processing of said displaying, wherein said replacements of said retrieved candidate word data are conducted concurrently for a plurality of said misspelled input word data.

13. An information processing apparatus as defined in claim 12, wherein:

said predetermined region comprises the last input line.

14. An information processing apparatus as defined in claim 13, wherein:

a first operation of a return key executes said processing for spelling checking and retrieving, and a second operation of said return key executes said replacement of the last input line and a processing for printing thereof.

* * * * *